United States Patent [19]

Gauger

[11] Patent Number: 4,519,289

[45] Date of Patent: May 28, 1985

[54] ADJUSTABLE CIRCUMFERENCE FLOOR TOM STAND

[76] Inventor: Gary L. Gauger, 15108 Highland La., Minnetonka, Minn. 55343

[21] Appl. No.: 569,447

[22] Filed: Jan. 9, 1984

[51] Int. Cl.[3] ..... G10D 13/02; G10G 5/00

[52] U.S. Cl. ..... 84/421

[58] Field of Search ..... 84/421

[56] References Cited

U.S. PATENT DOCUMENTS

| | | | |
|---|---|---|---|
| 2,433,594 | 12/1947 | Calo | 84/421 |
| 3,191,484 | 6/1965 | Walling | 84/421 |
| 4,158,980 | 6/1979 | Gauger | 84/421 |
| 4,254,047 | 2/1981 | Gauger | 84/421 |

*Primary Examiner*—Lawrence R. Franklin

*Attorney, Agent, or Firm*—Williamson, Bains, Moore & Hansen

[57] ABSTRACT

A stand for the mounting of floor toms is provided with a circular member having several inwardly directed flanges which engage the lugs of a drum. The circular member has a moderate adjustment as to circumference to provide optimum sound quality. Grommets and springs are utilized in conjunction with the flanges to mount the drum. Several supporting legs are utilized to suspend the circular member above the floor.

8 Claims, 4 Drawing Figures

ADJUSTABLE CIRCUMFERENCE FLOOR TOM STAND

BACKGROUND OF THE INVENTION

Traditionally, drums have been mounted primarily to provide for ease of assembly, disassembly and adjustment, and little thought has been paid to the effect of the mounting on the sound quality of the drum. In recent years, attempts have been made to improve the sound quality of drums by utilizing various mounting techniques. The mounting of individual toms with a snare drum type stand provides an improved sound but yet is impractical for kits having large numbers of drums. My prior U.S. Pat. No. 4,158,980 and 4,252,047 show a mounting technique which has substantially improved the sound quality of drums. The contents of those two patents are herein incorporated by reference. In particular, the latter of the above mentioned patents is used to mount a floor tom while improving the sound quality. While this has resulted in increased sound quality, that device is not ideally suited to mounting larger, heavier floor toms. Also, that device yields results which are not optimum when the drum is played in an especially enthusiastic manner.

Thus, it is an object of this invention to provide a floor tom stand which yields even more improved sound quality while at the same time provides a highly strong and stable stand for the heaviest of floor toms under the most extreme playing conditions. It is further an object of this invention to provide such a stand which is capable of fitting in conventional drum cases which may have already been purchased for the drum which is intended to be mounted. It is further an object of this invention to provide a stand which may be mounted to existing drums and which utilizes at least in part existing hardware for mounting purposes.

SUMMARY OF THE INVENTION

A circular member has first and second ends which are joined together via a fastener and elongated slot which allows modest adjustments in the circumference of the member. A circular member is formed with a diameter slightly larger than that of the castings in the rim of the drum which is to be mounted. At least three inwardly directed flanges are ideally, generally evenly spaced about the member and engage the lugs of the drum. A rubber grommet and accompanying coil spring serve to mount and isolate the drum on the circular member. Ideally three mounting brackets are provided to allow the use of the legs originally supplied with the drum to be used in supporting the drum above the floor or other supporting surface.

The adjustable feature of the arcuate member of the instant invention is mandated for reasons not readily apparent. In providing an arcuate member strong enough to withstand energetic playing and heavier and larger drums, no real flexibility will be inherent in the arcuate member as compared to earlier, lighter versions. Slight variations in the dimensions of all drums exist as, for instance, the dimensions between lugs. While one can easily mount a drum such as that shown without the adjustable feature by utilizing the elongated slots shown and rubberized grommets therein, the sound resulting from such mounting is not as desirable as might be expected. It has become apparent in the development of this invention that small variations in the circumference have an unexpectedly large influence on the sound quality which then emanates from the drum.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
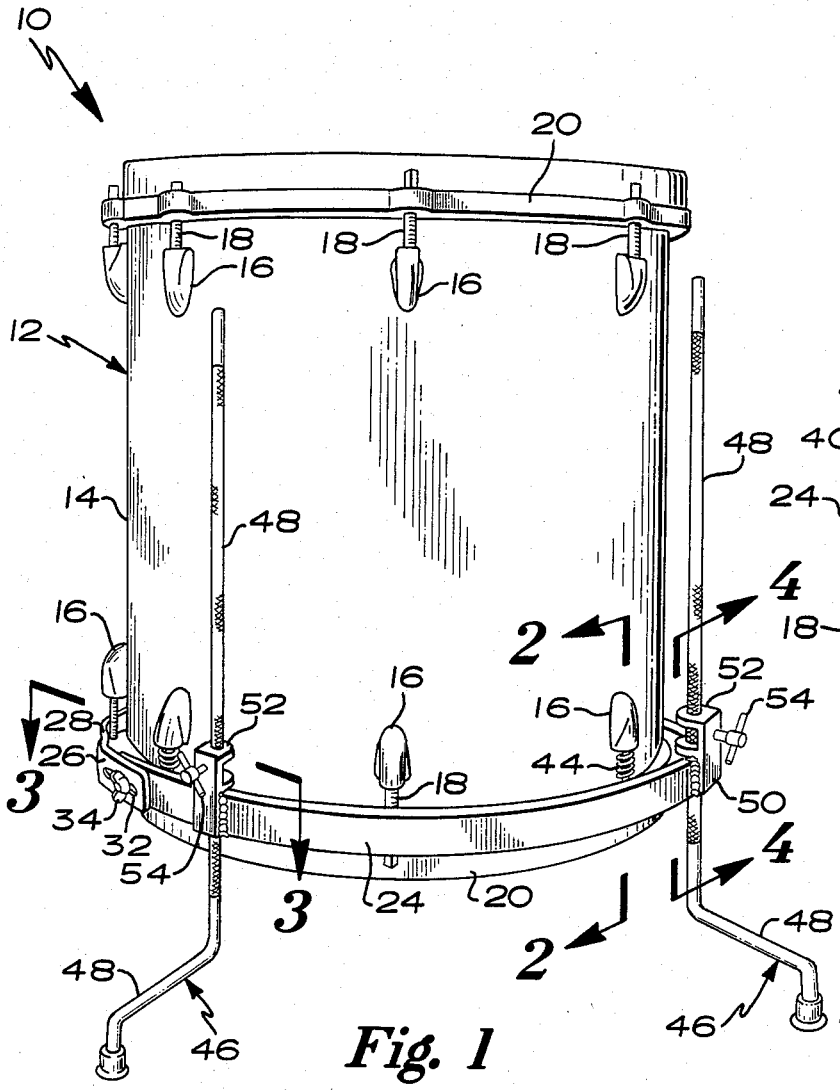
FIG. 1 is a front perspective view showing the invention of the instant application.

The instant invention, generally designated 10, is shown in FIG. 1 in conjunction with a conventional floor tom 12. As is entirely well known, tom 12 is composed of a generally cylindrical shell 14 having a plurality of castings 16 attached thereto, Casting 16 receives threaded lugs 18 which in turn are used to screwingly mount rim 20 to shell 14. Lugs 18 are also used to tune drum head 22, and the interaction of these parts is best seen in FIG. 2.

Generally speaking, arcuate member 24 is generally circular in nature and shape and is ideally formed of metal such as steel or any other conventional material. Arcuate member 24 has first and second ends 26 and 27. First end 26 has a slight jog or bend 28 therein which allows that end to overlap second end 27. A bolt 30 passes through holes in first and second ends 26 and 27, the hole in first end 26 being an elongated slot 32. A wing nut 34 is used to secure ends 26 and 27 relative to one another and thereby fix the circumference of arcuate member 24.

A plurality of radially inwardly directed flanges 36 are located by means of welding or other conventional fabrication techniques to arcuate member 24. Generally, at least three flanges 36 should be utilized and more may be used as desired depending on the drum to be mounted. Each flange 36 has a circumferentially elongated slot 38 therein. A grommet 40 is located in slot 38 and has located in turn therein a coiled spring 44 in recess 42 of grommet 40. Ideally, grommet 40 and spring 44 may be tuned to isolate the vibration of drum 12 from the floor and supporting surfaces.

Figure 2:
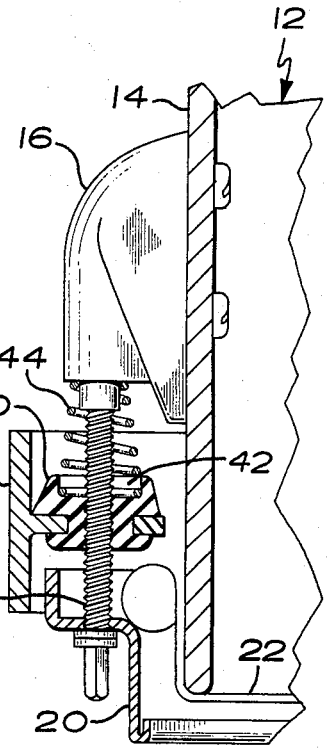
FIG. 2 is a sectional view taken along line 2—2 of FIG. 1.
Figure 4:
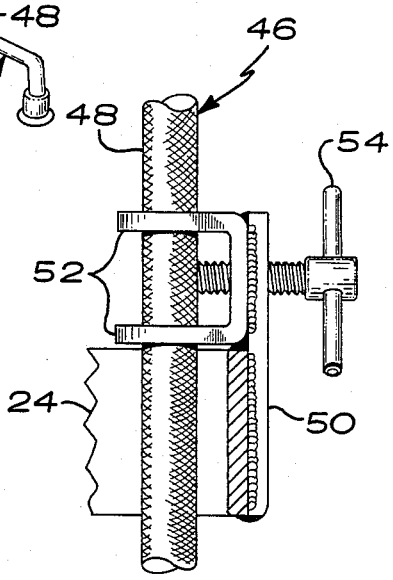
FIG. 4 is a sectional view taken along line 4—4 of FIG. 1.
Figure 3:
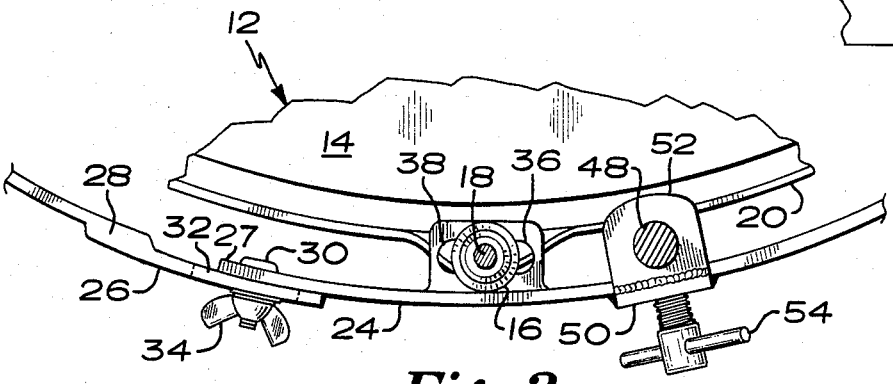
FIG. 3 is a sectional view taken along line 3—3 of FIG. 1.

As can be seen in FIGS. 2 and 3 in particular, arcuate member 24 is larger in diameter than the drum shell and the castings 16 and rim 20 thereon. This construction allows leg assemblies 46 to be mounted between shell 14 and arcuate member 24. The diameter of arcuate member 24 need not be too large for this purpose and, consistent with the above limitation, should be as small as possible to enable the drum and mount to fit existing cases and the like. In particular, a strap 50 extends upwardly from the outside of arcuate member 24. Affixed thereto is a channel-shape member having flanges 52, each flange having a hole therein for receiving leg 48. A wing bolt 54 is threadedly attached to strap 50 for clampingly engaging leg 48. In use, legs 48 are extended and wing bolt 54 clamped in place. Thence, the musician then proceeds to tune the drum in normal fashion and thence adjusts the circumference of arcuate member 24 by means of wing nut 34 until the drum rings loudest and longest.

While the preferred embodiment of the present invention has been described, it should be understood that various changes, adaptions and modifications may be made therein without departing from the spirit of the invention and the scope of the appended claims.

What is claimed is:

1. A mounting bracket for floor toms having a cylindrical shell and a plurality of lugs, said bracket comprising:

an arcuate member having two ends and having a diameter slightly larger than said shell, said member extending substantially the full circumference of said shell;

means attached to said member for engaging at least three of said lugs;

support means attached to said member for supporting said drum over a surface; and means attached to said member for varying the circumference thereof.

2. The mounting bracket of claim 1 wherein said engaging means comprises a plurality of flanges attached to and extending radially inwardly from said member, each of said flanges having an aperture therein to engage with one of said lugs.

3. The mounting bracket of claim 2 further comprising a vibration-absorbing means associated with each of said flanges.

4. The mounting bracket of claim 3 wherein said vibration-absorbing means comprises a plurality of grommets and each of said grommets is located in a corresponding said aperture.

5. The mounting bracket of claim 4, said vibration-absorbing means further comprising a spring in each said grommet.

6. The mounting bracket of claim 2 wherein said apertures comprise circumferentially elongated slots.

7. The mounting bracket of claim 1 wherein said support means comprises at least three legs.

8. The mounting bracket of claim 7, said member having a diameter large enough to mount said legs between said member and said shell.

* * * * *